US005677715A

United States Patent [19]

Beck

[11] Patent Number: 5,677,715

[45] Date of Patent: Oct. 14, 1997

[54] PIVOTING CAP ACTUATING ASSEMBLY FOR PRINTHEADS

[75] Inventor: John E. Beck, Pittsford, N.Y.

[73] Assignee: Xerox Corporation, Stamford, Conn.

[21] Appl. No.: 350,344

[22] Filed: Dec. 6, 1994

[51] Int. Cl.[6] ..... B41J 2/165

[52] U.S. Cl. ..... 347/29; 347/32

[58] Field of Search ..... 347/29, 30, 32

[56] References Cited

U.S. PATENT DOCUMENTS

| | | | |
|---|---|---|---|
| 4,819,012 | 4/1989 | Kiyohara et al. | 347/30 |
| 4,825,231 | 4/1989 | Nozaki | 347/30 |
| 4,970,534 | 11/1990 | Terawawa et al. | 347/32 |
| 5,027,134 | 6/1991 | Harmon et al. | 347/29 |
| 5,170,186 | 12/1992 | Shimamura et al. | 347/23 |
| 5,257,044 | 10/1993 | Carlotta et al. | 347/32 |

*Primary Examiner*—Benjamin R. Fuller
*Assistant Examiner*—L. Anderson
*Attorney, Agent, or Firm*—Fay, Sharpe, Beall, Fagan, Minnich & McKee

[57] ABSTRACT

A cap actuating assembly for an ink supply cartridge of a printer includes a pivoting member adapted for rotation about a pin between first and second positions. An actuating arm extends from the pivoting member and is operatively engaged by a printhead to begin the rotation and advancement of the cap into a sealed position. The entire cap actuating assembly is also slidably received on a support rail for limited movement between first and second stop members. Biasing members assist in removing the cap assembly from its sealed engagement and preparing the cap actuating assembly for sealing the printhead during the next storage operation.

17 Claims, 1 Drawing Sheet

PIVOTING CAP ACTUATING ASSEMBLY FOR PRINTHEADS

BACKGROUND OF THE INVENTION

The present invention relates to a printing apparatus or printer and is concerned, more particularly, with a cap actuating assembly for selectively covering and uncovering ink dispensing nozzles of a printhead. The invention is particularly applicable to an ink jet printer of the type where the printhead is mounted on a reciprocating carriage and will be described with particular reference thereto.

Ink jet printing apparatus conventionally use a printhead that is mounted adjacent a support surface, or printer platen. The platen supports a recording medium, typically paper, during the printing operation and suitable controls are provided for advancement of the paper in step-wise fashion, the details of which form no part of the subject matter of the present invention. The printhead is reciprocated along a guide rail that is disposed in parallel relation to an axis of rotation of the platen. As the printhead traverses a printing region defined within the area of the platen, ink is dispensed from the printhead in a desired pattern to form, for example, alphanumeric characters or the like.

Ink is dispensed from the nozzle through a series of small diameter nozzles in the printhead. Ink from a reservoir is supplied to the nozzle openings and rapidly heated by a series of electrodes or resistors provided in the printhead. The rapid heating vaporizes the ink to form a bubble that expels ink droplets from the nozzle openings in a desired manner. Careful control of the resistive elements in conjunction with timing of the movement of the printhead across the printing region results in ink droplets being dispensed from the printhead in the desired pattern.

When not in use, the printhead travels to a maintenance or storage area adjacent the printing region. When the printhead is idle for extended periods of time, and/or when the printer power is terminated, the printhead resides in the storage region away from the platen. Storing the printhead outside the printing region allows ease of access to the paper or to the mechanism which advances the paper through the printer. While in the storage area it is preferred to prevent the ink from drying out and clogging the nozzle openings of the printhead. The viscosity of the ink may be adversely affected when exposed to air since ink has selected components that are volatile, i.e. readily evaporated.

Moreover, dust and other small particles such as paper fibers and the like accumulate in the printer so that it is desired to cap the nozzle openings when not in use. Manual capping or covering of the printhead nozzles is not a feasible option. It has, therefore, been deemed desirable to provide a mechanism by which the printhead nozzle openings are automatically covered when the printhead is advanced into the storage region.

Commonly assigned U.S. Pat. No. 5,257,044 discloses one type of a cap actuation mechanism for such a printhead. There is a need for an alternate cap actuating mechanism to prevent exposure of the nozzle openings. Moreover, the actuating mechanism should preferably be relatively simple in construction and provide a reliable capping and uncapping of the printhead nozzles when the printhead enters into and exits out of the storage region, respectively.

SUMMARY OF THE INVENTION

The present invention contemplates a new and improved cap mechanism that overcomes the above-referenced problems and others and provides an economical and reliable mechanism that effectively covers the printhead nozzle openings.

According to a more limited aspect of the invention, a cap actuating assembly for ink dispensing nozzles of the printhead includes a pivoting member received on a pin for rotation between first and second positions. An actuating arm extends from the pivoting member and is disposed in a path of movement of the printhead as it enters the storage region. A cap mounted on the pivoting member is moved toward and away from the nozzle openings in response to movement of the pivoting member between its first and second positions.

According to another aspect of the invention, the pivoting member is mounted on a movable base for selective reciprocation during the capping procedure.

According to yet another aspect of the invention, a first biasing member urges the base toward a printing region of the printer and a second biasing member urges the cap away from the nozzle openings.

A principal advantage of the invention is the simplified structure for capping the nozzle openings of a printhead.

Yet another advantage of the invention resides in the effective capping actuating assembly that directly moves the cap into sealing position, removes the cap when the printhead is used, and prepares the cap for a subsequent capping operation.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof, and wherein.

DETAILED DESCRIPTION OF THE PREFERRED EMBODIMENT

Figure 1:
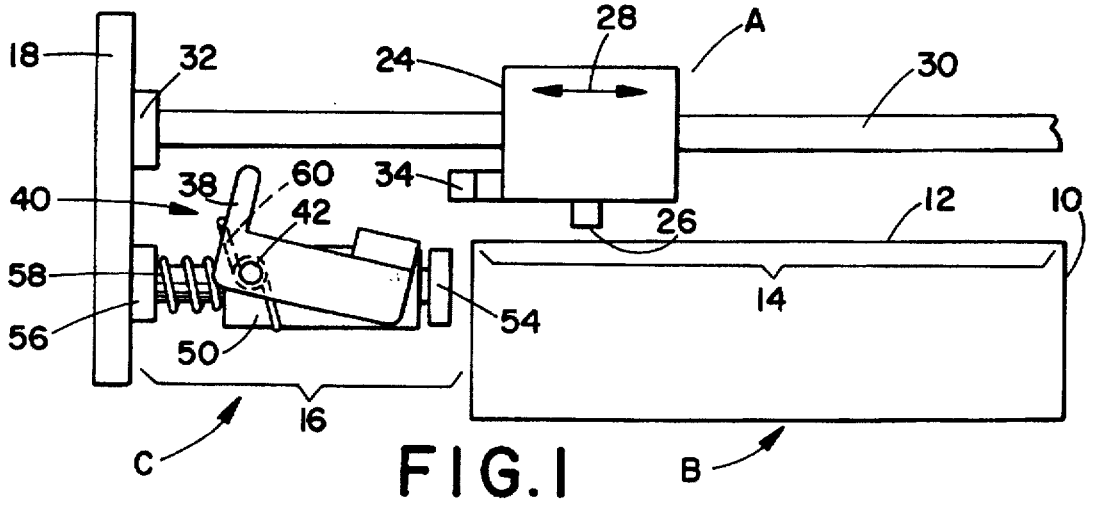
FIG. 1 is a schematic front elevational view of a printhead disposed in a printing region and a cap actuating assembly in an adjacent storage region.

Referring now to the drawings wherein the showings are for the purposes of illustrating the preferred embodiment of the invention only and not for purposes of limiting same, the FIGURES show portions of a printing apparatus that include a printhead a disposed adjacent a recording medium support surface or platen B and a cap actuating assembly C disposed adjacent the platen.

More particularly, the platen B is adapted for rotation about a longitudinal axis 10, typically oriented in a horizontal direction. As is well known in the art, a feed mechanism is provided so that continuous feed paper or an individual sheet of paper is supported along the external surface of the platen and incrementally advanced as the platen is rotated about its axis during the printing operation. Generally, the surface area of the platen that receives the paper defines the printing region as designated by numeral 14. This is separate from and disposed adjacent to a storage or maintenance region 16 within housing 18 of the printer. Particular structural and functional details of the remainder of the printer are well known in the art and eliminated from illustration herein since they form no part of the subject invention.

The printhead A includes a carriage 24 that carries a cartridge that contains a reservoir of ink. The ink is dispensed from the printhead through nozzle openings 26. The ink cartridge is removably mounted to the carriage so that upon depletion of the ink the old cartridge can be removed and a new cartridge with a fresh supply of ink positioned thereon.

As represented by arrows 28, the carriage/printhead is adapted for reciprocating movement on a guide rail 30. The guide rail is disposed parallel to the platen axis 10 so that the printhead is reciprocated along the length of the platen, that is through the printing region, as desired. The guide rail is supported in any suitable manner at opposite ends, one end 32 of which is shown secured to the housing 18 and the other end (not shown) similarly secured to the housing.

Figure 2:
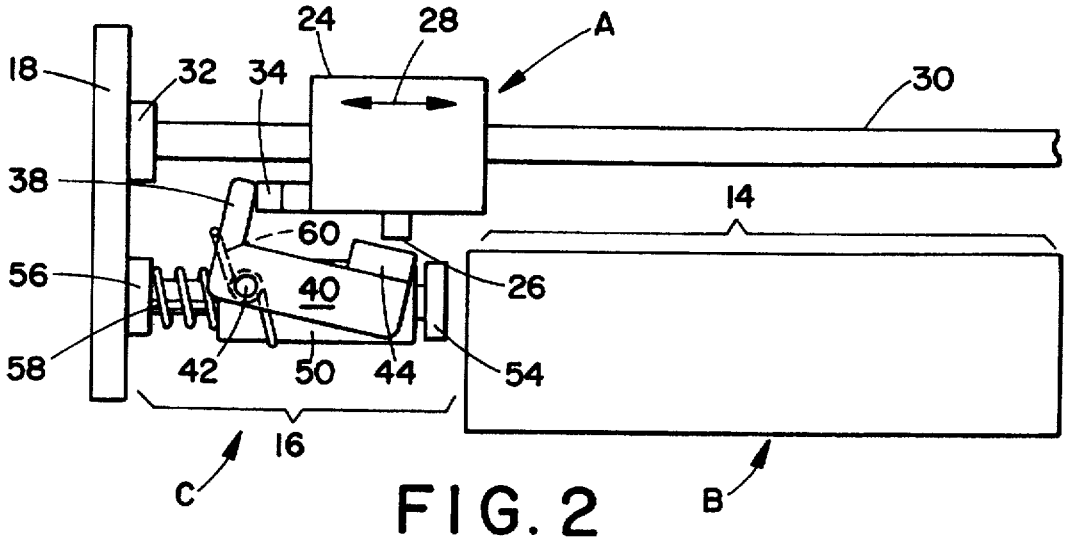
FIG. 2 is a view similar to FIG. 1 of the printhead moving in transition from the printing region to the storage region, or vice versa.

As shown in FIG. 1, the printhead A is disposed in the printing region 14 during the printing operation. During a period of non-use, for instance when the printer is turned off or during an extended standby period, the printhead proceeds leftwardly along guide rail 30 thereby exiting the printing region 14 and entering the storage region 16. This is best illustrated in FIG. 2 where the drawing represents the printhead as it either enters or exits the maintenance region. A projecting member 34 extends outwardly from the printhead. Preferably, the projecting member extends axially outward from the printhead so that it defines a first portion of the printhead that enters the maintenance region. The projecting member can adopt various configurations but is shown in a simplified form as an elongated arm.

The projecting member is adapted for engagement with an actuating arm 38 of a pivoting member 40 of the cap actuation assembly. Particularly, the pivoting member 40 rotates about a pin 42, although the pivoting member is shown in its normal, deactuated position in FIG. 1 and 2. As will become more apparent below, as the printhead continues its travel from the printing region into the storage region, the pivoting member 40 rotates in a generally counterclockwise direction (as shown). This rotation or pivoting movement moves a cap 44 into sealing engagement over the nozzle openings of the printhead. The cap is preferably mounted at one end of the pivoting member on the opposite side of pin 42 from the actuating arm. Thus, as the actuating arm is urged by printhead to rotate about the pin, the cap is selectively advanced and retracted over the nozzle openings 26. It will be understood that in selected applications the member 34 need not project outwardly from the printhead. It can be defined as a region or area on the printhead that contacts the cap actuation assembly.

As shown, the pivoting member 40 has a generally L-shaped configuration with the actuating arm 38 extending outwardly from one end and the cap 44 disposed at an opposite end for rotation as a unit about the pin 42. Preferably, the arm is formed as an integral portion of the pivoting member. Moreover, the cap 44 is formed of a resilient material that creates a seal about the printhead nozzles and limits exposure of the nozzle openings, and more importantly the ink in the openings, to the atmosphere.

Figure 3:
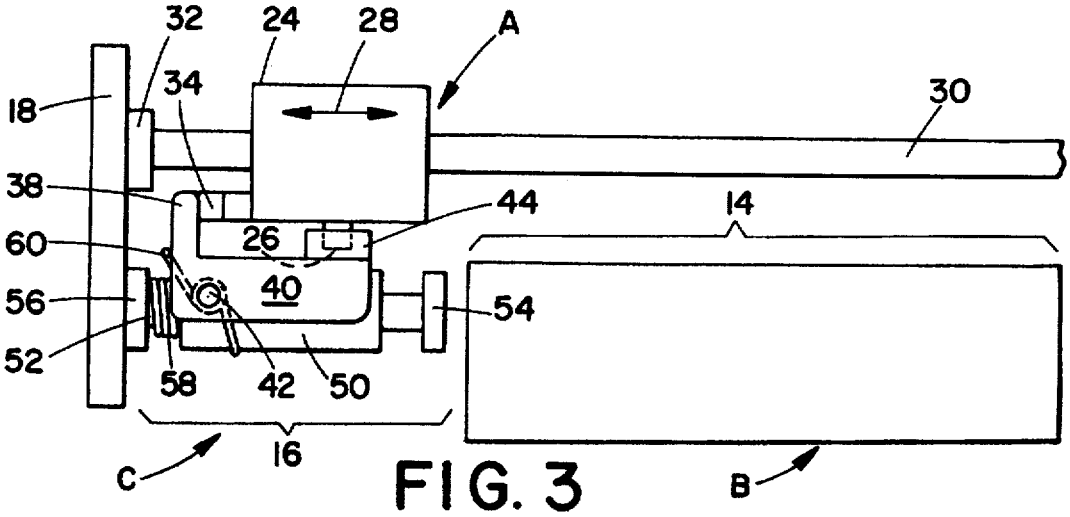
FIG. 3 is a view similar to FIG. 1 and 2 and illustrating the cap in an actuated position over the printhead nozzles.

The pin is secured to a base 50 that is slidably received on a support rail or guide member 52. Opposite ends of the support rail include first and second stop members 54, 56. The stop members limit the extent of movement of the base in a direction parallel to the guide rail 30. As best exemplified by a comparison of FIG. 1–3, the base is normally disposed rightwardly toward the first stop member 54 by a first biasing member such as a spring 58. This urges the cap actuating assembly into position for engagement with the projecting member 34 of the printhead. As the printhead proceeds leftwardly into the maintenance region, the actuating arm and projecting member abut and the pivoting member begins to rotate about pin 42. The continued leftward movement of the printhead slides the entire cap actuating assembly C along the support rail 52 toward the second stop member 56.

Once the movable base 50 engages the second stop member 56, continued axial advancement of the carriage 24 or printhead relative to the cap actuating assembly rotates the pivoting member 40 about pin 42. Specifically, the projecting member 34 continues to push the actuating arm 38 which causes counterclockwise rotation of the pivoting member about the pin. The counterclockwise rotation brings the sealing cap 44 into covering relation with the nozzle openings 26.

As will be understood, pivoting member 40 may be urged toward its deactuated position as shown in FIGS. 1 and 2 by a second biasing member or spring 60. The spring is shown in phantom as a flat spring that urges the pivoting member in a clockwise direction about the pin, but can adopt any of a number of different configurations as will be understood by those skilled in the art. Depending on the relative biasing forces of the first and second springs 58, 60, the closing action of the cap actuation assembly described above may be slightly altered. That is, rotation of the pivoting member about the pin bringing the cap into sealed relation with the nozzle openings may be completed before the axial movement of the base occurs. Thereafter, the entire assembly may then slide leftwardly on support rail 52 until it engages the stop member 56. Alternatively, a sliding action may occur initially and once the base engages the second stop member, rotation of the pivoting member commences. It will be understood that these relative actions or operative steps depend on the forces exerted by the first and second biasing springs. Under any of these scenarios, however, the nozzle openings 26 on the printhead are effectively capped and sealed as the printhead travels into the storage region.

Likewise, once the printhead leaves the storage region and is advanced back into the printing region 14, biasing forces of the first and second springs 58, 60 assure that the cap is effectively removed from the nozzle openings and the cap actuation assembly prepared for the next capping operation. To that end, the cap actuation assembly engages the first stop member 54 which limits rightward travel of the cap actuation assembly on the support rail. Thus, the printhead and cap actuating assembly move from the position shown in FIG. 3 where the printhead nozzle openings are covered to the position shown in FIG. 2 where the base engages the first stop member and the pivoting member has begun its rotation about the pin. The nozzle openings are now open to atmosphere and the printhead ready to proceed with a further printing operation.

It will be understood by one skilled in the art that the cap actuating assembly may adopt a number of various configurations. For example, the pivoting member, actuating arm and cap need not be a unitary member but can be assembled from different components. Alternatively, the pivoting member need not adopt the particular configuration shown and described in this specification. It is contemplated, however, that the combined action of a pivoting and sliding action provides for an effective and reliable sealing of the nozzle openings once the printhead enters the storage region. On the other hand, once the printhead moves into the printing region, the cap actuation assembly automatically and effectively uncovers the nozzle openings and prepares itself for receipt of the printhead during the next storage operation.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. A cap actuating assembly for ink dispensing nozzles of a printhead of a printing apparatus, the printhead being reciprocally moved along an axis through a printing region in response to a drive assembly and through a storage region where a cap is advanced toward the printhead in a direction generally perpendicular to the axis for sealing the nozzles, the actuating assembly comprising:

a pivoting member that is received on a pin mounted on the printing apparatus for rotation about the pin between first and second positions;

an actuating arm extending from the pivoting member and disposed in a path of movement of the printhead as the printhead enters the storage region;

a movable base on which the pivoting member is mounted for selective reciprocation in a direction generally parallel to the axis; and a cap mounted on the pivoting member for selected movement toward and away from the sealing relation with the nozzles in response to movement of the pivoting member between the first and second positions of the actuating arm.

2. The cap actuating assembly as defined in claim 1 wherein the base is received on a guide member offset and parallel to the axis and further comprising first and second stop members for limiting movement of the base thereon.

3. The cap actuating assembly as defined in claim 2 including a biasing member for urging the base toward the first stop member.

4. The cap actuating assembly as defined in claim 3 wherein the first stop member is located closer to the printing region than the second stop member.

5. The cap actuating assembly as defined in claim 4 further comprising a second biasing member for urging the actuating arm toward the first position spaced from the nozzles of the printhead.

6. The cap actuating assembly as defined in claim 1 wherein the pivoting member, actuating arm, and cap are a one piece member.

7. The cap actuating assembly as defined in claim 1 further comprising a projecting member extending from the printhead for operative engagement with the actuating arm upon movement of the printhead into the storage region.

8. A cap actuating assembly for an ink jet printhead that reciprocates along a guide rail, the cap actuating assembly selectively sealing around ink dispensing nozzles of the printhead when it enters a storage region adjacent a printing region of a printer, the cap actuating assembly comprising:

a pivoting member received on a pin mounted on the printer for selective rotation between a deactuated first position and an actuated second position;

a movable member mounted for sliding movement along a support rail that is paralled to the guide rail and receiving the pivoting member thereon;

an actuating arm operatively associated with the pivoting member and disposed in a path of the printhead for engagement therewith;

a cap mounted on the pivoting member for selectively sealing the nozzles of the printhead when the pivoting member is disposed in the second position; and a biasing member for urging the pivoting member toward the first position.

9. The cap actuating assembly as defined in claim 8 further comprising first and second stop members at opposite ends of the support rail for limiting axial movement of the movable member thereon.

10. The cap actuating assembly as defined in claim 9 further comprising a second biasing stop member adjacent the printing region of the printer

11. The cap actuating assembly as defined in claim 8 further comprising a projecting member extending from the printhead for selective engagement with the actuating arm of the cap actuating assembly

12. A cap actuating assembly for use in selectively covering ink dispensing nozzles of an ink jet printhead of a printer, the printhead selectively reciprocated along a guide rail in a printing region and stored in a storage region of the printer, the cap actuating assembly automatically covering the nozzles upon entry of the printhead into the storage region, the cap actuating assembly comprising:

a support rail offset and parallel to the guide rail;

a base member received on the support rail for sliding movement between opposite ends of the support rail;

a pin mounted on the base member; and a pivot member received on the pin for selective movement between an actuated first position and a deactuated second position, the pivot member including an actuating arm extending therefrom and into a path of movement of the printhead as the printhead enters the maintenance region of the printer and a cap spaced from an actuating arm adapted for generally perpendicular movement toward and away from the printhead nozzles in response to movement of the actuating arm.

13. The cap actuating assembly as defined in claim 12 further comprising a first biasing member urging the base member toward the printing region of the printer.

14. The cap actuating assembly as defined in claim 13 further comprising a second biasing member urging the pivot member toward the second position.

15. The cap actuating assembly as defined in claim 12 wherein the actuating arm is disposed in the path of the printhead in both the first and second positions.

16. A cap actuating assembly for ink dispensing nozzles of a printhead of a printing apparatus, the printhead being reciprocally moved along an axis through a printing region in response to a drive assembly and through a storage region where a cap is advanced toward the printhead in a direction generally perpendicular to the axis for sealing the nozzles, the actuating assembly comprising:

a pivoting member that is received on a pin mounted on the printing apparatus for rotation about the pin between first and second positions;

an actuating arm extending from the pivoting member and disposed in a path of movement of the printhead as the printhead enters the storage region;

a projecting member extending from the printhead for operative engagement with the actuating arm upon movement of the printhead into the storage region; and a cap mounted on the pivoting member for selected movement toward and away from the sealing relation with the nozzles in response to movement of the pivoting member between the first and second positions of the actuating arm.

17. A cap actuating assembly for an ink jet printhead that reciprocates along a guide rail, the cap actuating assembly selectively sealing around ink dispensing nozzles of the printhead when the printhead enters a storage region adjacent a printhead region of a printer, the cap actuating assembly comprising:

a pivoting member received on a pin mounted on the printer for selective rotation between a deactuated first position and an actuated second position;

an actuating arm operatively associated with the pivoting member and disposed in a path of the printhead for engagement therewith;

a projecting member extending from the printhead for selective engagement with the actuating arm of the cap actuating assembly;

a cap mounted on the pivoting member for selectively sealing the nozzles of the printhead when the pivoting member is disposed in the second position; and a biasing member for urging the pivoting member toward the first position.

* * * * *